US005447752A

United States Patent [19]

Cobb

[11] Patent Number: 5,447,752

[45] Date of Patent: Sep. 5, 1995

[54] METHOD FOR MAKING A DECORATIVE CEMENTITOUS PATTERN ON A SURFACE

[76] Inventor: Clyde T. Cobb, P.O. Box 2922, West Columbia, S.C. 29171

[21] Appl. No.: 257,699

[22] Filed: Jun. 9, 1994

Related U.S. Application Data

[62] Division of Ser. No. 1,828, Jan. 8, 1993, abandoned.

[51] Int. Cl.[6] ..... B05D 5/00; E04B 1/16

[52] U.S. Cl. ..... 427/270; 427/140; 427/272; 427/277; 427/278; 427/282; 264/31; 264/DIG. 31

[58] Field of Search ..... 427/140, 264, 265, 270, 427/272, 278, 282, 277, 355; 156/280; 264/31, 33, 35, 133, DIG. 31

[56] References Cited

U.S. PATENT DOCUMENTS

| | | | |
|---|---|---|---|
| 2,110,335 | 3/1938 | Kritzer | 427/272 |
| 2,595,142 | 4/1952 | Herck . | |
| 3,712,825 | 1/1973 | Yocum | 427/282 |
| 4,239,820 | 12/1980 | Salvador | 427/282 |
| 4,697,464 | 10/1987 | Martin | 73/866.3 |
| 4,959,250 | 9/1990 | McKinnon | 427/270 |
| 5,167,991 | 12/1992 | Lowe | 427/270 |
| 5,169,573 | 12/1992 | Tsuchida et al. | 264/DIG. 31 |

FOREIGN PATENT DOCUMENTS

| | | | |
|---|---|---|---|
| 4-202264 | 7/1992 | Japan | 427/278 |

*Primary Examiner*—Terry J. Owens
*Attorney, Agent, or Firm*—Michael A. Mann

[57] ABSTRACT

A surface coating composition comprising generally cement, sand, a polymer binder, and water, and a method for applying the composition to a surface. The composition is used to apply an ornamental surface coating onto a pre-existing cementitious surface, or a surface to which a cementitious base layer has been applied. The surface is cleaned with a muriatic acid solution. A flexible plastic template is laid on the surface to define the desired pattern and a thin layer of the composition is applied. The template is removed after the composition is applied. After the composition starts to cure, the surface is wiped with a damp sponge to round off corners and open up surface pores. The surface is sealed after curing. Texturizing rollers may be used to provide a more realistic finish. The coating is tough and durable, and can withstand up to approximately 6,000 psi (about 400 kg/cm$^2$) pressure.

5 Claims, 1 Drawing Sheet

METHOD FOR MAKING A DECORATIVE CEMENTITOUS PATTERN ON A SURFACE

This is a divisional of copending application Ser. No. 08/001,828 filed on Jan. 8, 1993, abandoned.

BACKGROUND OF THE INVENTION

1. Field of the Invention

The present invention relates to decorative surface coatings. In particular, the present invention relates to a method for applying a cement coating that simulates the appearance of brick and stone.

2. Discussion of Background

Concrete and asphalt are widely used in the construction of driveways, paths, patios, pool decks, parking lots, and so forth. Building materials such as brick, stone, slate, and tile are generally considered to be more esthetically pleasing than concrete or asphalt. However, these materials are more expensive to install.

Existing concrete or asphalt surfaces will eventually deteriorate and must be repaired or replaced. For example, a driveway may settle or develop cracks. Small areas may be patched or sealed; more extensive damage necessitates laying down a new surface. Damaged concrete or asphalt may be resurfaced with a fresh coating of the same material rather than replacing it with a different, more pleasing material.

Surface coatings that simulate the appearance of brick or stone are well known. Also, a number of materials and techniques for coating wood, metal and concrete are available. Templates or stencils may be used to form ornamental patterns on concrete. The coatings may be colored to approximate the colors of brick, stone, and so forth. See, for example, Krauss (U.S. Pat. No. 1,853,824), Amele (U.S. Pat. No. 1,592,591), Reuter-Lorenzen (U.S. Pat. No. 1,583,748). Diana (U.S. Pat. No. 4,665,673) uses a template to create an ornamental surface for pre-cast concrete walls such as traffic barricades. Dufford (U.S. Pat. Nos. 2,748,443 and 2,616,145) uses a changeable-pattern stencil for applying a facing to building walls. Syring (U.S. Pat. No. 4,510,729) discloses a texture roller to enhance the simulation of textured brick and a template that is flexible and waterproof such as impregnated paper.

Despite the variety of techniques available, there is a need for a method of applying a decorative surface coating that effectively simulates brick or stone and is durable and easily applied to several types of pre-existing surface, including concrete, asphalt, and wood surfaces.

SUMMARY OF THE INVENTION

According to its major aspects and broadly stated, the present invention is a surface coating composition comprising generally cement, sand, a polymer binder, and water, and a method for applying the composition to a surface. The composition is used to apply a decorative surface coating onto a pre-existing cementitious surface, or a surface to which a cementitious base layer has been applied as a preparatory step. The surface is cleaned with muriatic acid solution before applying the composition. A plastic template is then laid on the surface to define the desired pattern, and the composition is spread across the surface. The template is then removed. After the composition starts to cure, the layer is gently wiped with a damp sponge to round off sharp corners and open up surface pores. The layer is sealed after curing. Additional treatments including color additives and curing retardants may be added to the composition before application. After application, texturizing rollers may be used to provide a more realistic surface finish. The coating is tough and durable.

An important feature of the present invention is the combination of the binder, cement, sand, and water to form the composition. The binder is an acrylic latex polymer, preferably styrene butadiene that is easily workable and forms a tough and long-wearing surface.

Another feature of the present invention is the template. The template consists of a network of openings forming a predetermined pattern such as may be formed with bricks, tiles, irregularly-shaped stone or slate, or any other desired surface structure. The template is made of a smooth, flexible, moisture-resistant material such as polypropylene, polyurethane, polyethylene, or similar plastic. Because the templates are easily made, a variety of patterns can be used and patterns can be customized for particular applications.

Several features of the mode of application of the composition are important. Both cementitious surfaces and non-cementitious surfaces can be coated. In the case of asphalt or wood surfaces, a cementitious surface are applied first and then the composition of the present method is begun. These include the use of a template to create grout lines that can then be filled in with mortar-colored composition; the sponging of the still-uncured composition to open pores and round corners; and the application of a layer that is only ¼ inch, typically, to achieve the desired appearance and durability.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
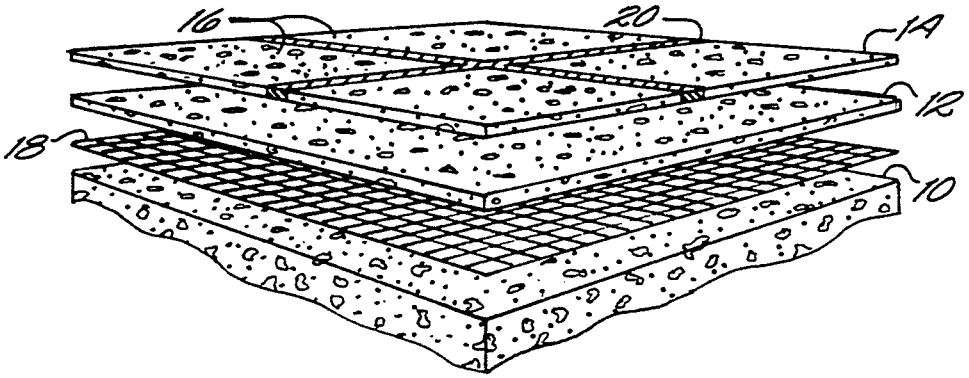
FIG. 1 is an exploded perspective view of a surface coated with the composition according to a preferred embodiment of the present invention.

A surface coating composition according to the present invention generally comprises cement, sand, a polymer binder, and water. Color additives may be added to simulate the color of bricks, stone, tile, and so forth. To a cementitious base, either pre-existing or applied as a pretreatment to a wood or asphalt surface, the composition is applied to form an ornamental surface. A flexible plastic template, laid on the surface, defines the pattern of "bricks," "stones," or other desired surface structure. A thin layer of the composition is applied to the surface either before or after the template is positioned. If the template is laid before application of the composition, it is removed just as the composition begins to cure. If laid on the freshly applied composition, it is removed after coloring pigment is applied to the composition. After the layer starts to cure, it is wiped with a damp sponge to round off sharp corners and to open up surface pores for better acceptance of a sealer. An additional treatment includes the use of texturizing rollers to provide a more realistic surface finish.

The composition is prepared as follows:

1. Prepare the binder solution. Add approximately two parts water to one part binder and stir until thoroughly blended to form a first mixture. In a dry state, the binder is approximately 46.5 vol. %–47.5 vol. % solids. The binder solution contains up to approximately 20 vol. % solids (at least approximately 80 vol. % water), depending on the amount of water added.

The binder is an acrylic latex polymer, preferably styrene butadiene, commonly used in making synthetic rubber or as a binder in paints. Styrene ($C_6H_5.CH:CH_2$) and butadiene in the form of its isomer, erythrene ($CH_2.CH:CH.CH_2$), may be combined as copolymers to form a tough and long-wearing composition. Alternatively, some other polymer with similar qualities of toughness and durability may be used. It will be understood that the amount of water added may need to be adjusted for different mixtures of different polymers. The optimum ratio of solids to water is best determined by observation and a modest amount of experimentation for each particular polymer.

2. Mix cement and sand to form a second mixture. The second mixture preferably contains approximately 30–40 wt. % cement, most preferably approximately 33% cement and 66% sand. Pre-mixed formulations that contain suitable proportions of cement and sand, so-called mortar mix or grout mix, may be used if convenient.

3. Combining the two mixtures. Add approximately 2–3 gallons (about 8–11 liters) of the first mixture (polymer solution) to 100 pounds (about 45 kg) of the second mixture (cement and sand), and stir or agitate until well blended. Preferably, the resulting composition has approximately the consistency of pancake batter.

The optimum proportions of the first and second mixtures depend on whether the composition is to be applied to the surface manually or by spraying. Thinner compositions containing more polymer solution are preferred for spraying; for spreading manually with a trowel, thicker compositions are preferred.

4. Adding a color additive to the mixture. Dry cement or grout mixtures are typically white or gray in color. If a different color is desired for the surface to be treated, a color additive such as an oxide powder, is dispersed throughout the composition. Stir until well blended, preferably for at least four minutes. Alternatively, the color additive is added to the binder solution (step 1). While other types of coloring agent may be used if desired, the color additive is preferably a UV-resistant additive such as an oxide powder, which can be stored in dry form and added to the mixture at the site.

The composition is typically applied in thin layers (less than ¼" or 0.6 cm thick). To prevent overly rapid curing, a retardant such as is commonly used in the an of working concrete is added to the composition. The retardant slows down the curing of the composition, allowing the user sufficient time to treat the surface as will be described below.

The composition may easily be prepared at the work location, since all the ingredients are transportable and need only be mixed with water just prior to use. The composition is applied to a pre-existing, cementitious surface as follows:

1. Prepare the pre-existing surface. In order for the composition to adhere to a surface, the surface must be clean. Acid-etch the surface with a solution containing approximately five to ten parts water to one part muriatic acid. Sprinkle the muriatic acid solution onto the surface in an amount sufficient to dampen the surface. Brush with a stiff bristle broom to promote dispersion and interaction between the solution and the surface. Do not allow the surface to dry.

After approximately ten minutes, pressure-clean the surface with water. Pressure-cleaning, preferably at a pressure of about 3,000 psi (about 200 kg/cm$^2$), removes the acid solution and cleans the surface pores of the cementitious structure.

2. Place a template of the desired pattern onto the surface. The template is centered on the surface and oriented as desired. If the work area is not square, it is necessary to compensate by adjusting the placement of subsequent templates by overlapping, taping, pinning, rotating, and so forth. Mask and/or shield the work area to prevent overspray of the composition into adjacent locations.

The template comprises a smooth, flexible, moisture resistant material such as polypropylene, polyurethane, polyethylene, or similar low density plastic having a plurality of openings forming a pattern such as those usually made with bricks, tiles, irregularly-shaped stone or slate, and so forth. The template itself defines a pattern of "grout" lines. The thickness is between approximately 1/16" (about 0.2 cm) and ⅛" (about 0.3 cm), preferably approximately 3/32" (about 0.2 cm). Templates thinner than approximately 1/16" (about 0.2 cm) are difficult to handle and tend to break easily; templates thicker than approximately ⅛" (about 0.3 cm) may develop hairline cracks in use. Templates are preferably supplied in a convenient size for use, such as approximately 2'–3' (about 60–90 cm) wide by approximately 6'–10' (about 1.8–3.0 m) long.

Several templates may be arranged to cover an area or one template may be moved from section to section. If desired, templates may be cut to fit irregularly-shaped borders. Additional structural features such as pre-fabricated edging, drainage channels, and so forth may be incorporated simply by arranging the templates accordingly.

3. Apply a layer of the composition to the surface, spreading the composition into the openings of the template. The composition may be sprayed or spread manually onto the surface. As noted above, thicker formulations of the composition are generally more suitable for manual application; thinner formulations are preferred for spraying.

When the composition is applied by hand, uniform, back-and-forth and circular motions are used to spread the composition evenly across the work area. In this case, the thickness of the surface layer is approximately equal to the thickness of the template.

When the composition is sprayed, application is most effective when the sprayer is kept constantly in motion while spraying downwards onto the template. The thickness of a sprayed layer is no more than the thickness of the template (approximately 3/32" or about 0.2 cm), and can be as little as approximately 1/64" (about 0.04 cm).

The composition is preferably used at temperatures greater than about 45° F. (about 7° C.). At high temperatures (greater than about 90° F. or about 32° C.), ice may be added to the composition to lower the temperature for proper viscosity.

4. Remove the template and move it to the next area to be treated. When placing the template in a new work area, overlap the border of the template into the previously-treated area by about 1′ (about 30 cm) to help maintain the course of the pattern.

Small fragments of the composition may adhere to the template when it is lifted from the work area. Typically, however, a template can be used at least twice before cleaning is needed. The template is cleaned simply by placing it on a plastic or plywood sheet and rinsing with water. If needed, the template may be wiped with a sponge or scrubbed with a medium- or a soft-bristle broom to remove any remaining fragments.

5. The wet composition is generally darker than the cured coating layer. As the coating begins to cure, its surface "flashes" as indicated by lightening of the composition's shade. After flashing, lightly wipe the area with a damp sponge. Sponging smoothes high spots in the surface of the newly-applied layer, rounds off corners, imparts a non-skid finish, and increases the porosity of the surface for better penetration of the sealant. Sponging also removes tooling marks that may remain after manual application of the composition.

6. Clean out the "grout" lines that define the pattern formed by the template. These lines may partially fill in if the composition is displaced during the sponging step. The lines can easily be re-formed using a grouting tool such as is well known in the art.

7. If desired, the surface may be marked or scored to simulate old brick using a textured roller. The roller has projecting portions that produce corresponding indentations when rolled over the surface. For example, a roller might have irregular projections that mimic the small cracks and imperfections found in natural brick, or an uneven surface that approximates the appearance of stone or slate.

8. After the newly-applied layer of the composition cures, sweep the surface with a medium or hard-bristle broom, then use an air blower to thoroughly remove accumulated dust and grit.

9. Apply a sealer to the cured surface. Preferably, at least two coats of sealer are applied to provide good protection and wear-resistance. The sealer may be applied by hand, or with an airless sprayer or low pressure sprayer such as are known in the art. When the sealer is applied manually with a roller, lateral rolls with transverse back-rolls help minimize roller marks in the finished surface.

A surface coating such as that described above is tough and durable. It can withstand up to approximately 6,000 psi (about 400 kg/cm$^2$) pressure, as compared to conventional concrete which can withstand about 3,300 psi (about 230 kg/cm$^2$). The composition of the present invention can be applied to a pre-existing concrete surface or a freshly-laid surface. The template can be provided in any desired pattern, including familiar brick and tile patterns, or irregular patterns simulating natural stone or slate. The coating may be colored in such colors as brown, black, gray, reddish-brown, and so forth, or any other desired color.

Figure 2:
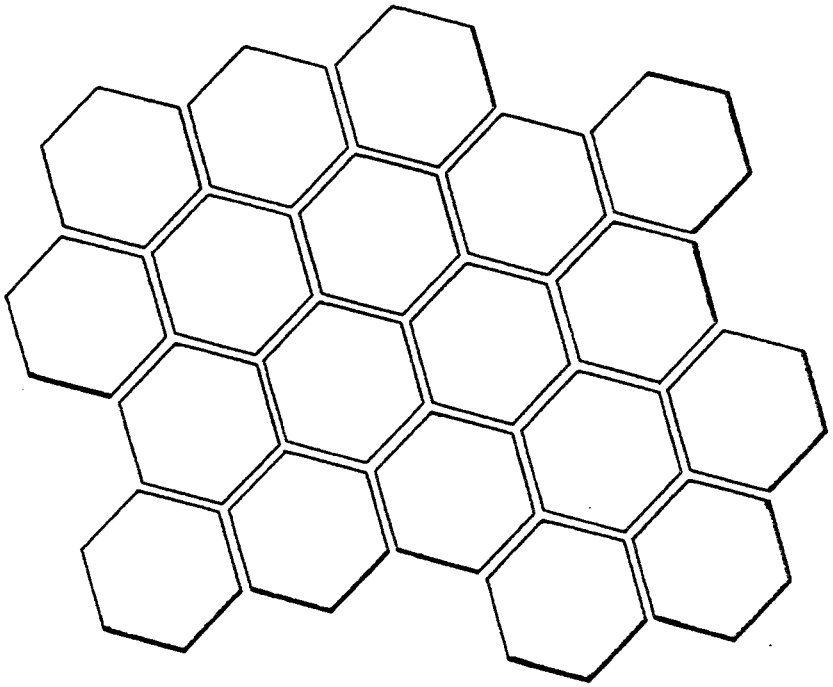
FIG. 2 is a partial view of a template for use in applying the composition to a pre-existing surface.

Referring now to FIG. 1, there is shown a surface coated with the composition according to the present invention. Surface 10 is coated with first layer 12 and second layer 14 of the composition. First layer 12 forms a smooth base coating over the pre-existing surface; second layer 14 has "bricks" 16 formed therein, using a template having a brick pattern. Surface 10 may also include mesh layer 18 and grout 20, to be described below. Templates may incorporate any desired pattern, including, for example, the hexagonal pattern shown in FIG 2.

Numerous variations to the application process described above are possible within the spirit of the present invention. For example, if the pre-existing surface is uneven, it is cleaned as in step 1 and a base coating (represented in FIG. 1 by first layer 12) is applied before proceeding with step 2. This procedure is also used to apply the composition to a pre-existing asphalt surface. The base layer may consist of the composition or a conventional concrete mixture, as may be convenient. The base coating may be sprayed onto the surface, spread manually with a trowel or squeegee, or applied by any other means known in the art.

A base layer of the composition may be applied to a wooden surface generally as follows. A flexible metal mesh fabric (hardware cloth or similar material) may be attached to the wood to serve as a substrate for the composition. The fabric is stapled, nailed, or otherwise attached to the wooden surface, as indicated by layer 18 in FIG. 1. The composition penetrates the structure of the fabric and adheres to the wood surface. The wood may be roughened, such as by sanding, to promote better penetration and adhesion of the composition.

Conventional grouting may be applied to the surface after the composition cures (see grout 20, FIG. 1 ). This may be done either before or after application of the sealer (step 10). If desired, grouting may be applied to the surface between applications of the sealer.

The composition may be applied to the surface before placing the template. A thin layer of the composition is applied and spread evenly. The template is placed on the surface and gently pressed into the composition before it starts to cure. After the patterned composition begins to cure, the template is removed and the surface may be treated as described above. A layer so formed may be approximately the same thickness as a layer formed by applying the composition to a prepositioned template but may be thicker if desired.

Two or more layers of the composition may be used to create a decorative appearance. For example, a base layer may simulate "grout" lines and a second, surface layer simulate "brick."The base layer is provided in the desired color of the "grout" lines. The second layer is applied after the first layer dries, using a template having a brick pattern formed therein so that the first layer is visible in the spaces between the "bricks."Each of the layers may be sprayed or applied manually, as may be convenient.

In addition, the oxide color additive of the invention may be used as a color hardener for conventional stamp concrete. A powdered oxide coloring agent is blended with pre-mixed dry grout in an amount up to approximately 3 wt. %, depending on the choice of color and the desired hue. The dry mixture is spread over uncured stamp concrete and worked in according to methods well known in the art. Unlike conventional coloring agents, the oxide and grout can be stored and transported in dry form and mixed as needed at the work site, resulting in significant equipment and storage costs.

It will be apparent to those skilled in the art that many changes and substitutions can be made to the preferred embodiment herein described without departing from the spirit and scope of the present invention as defined by the appended claims.

What is claimed is:

1. A method for making a decorative pattern on a surface, said method comprising the steps of:

etching said surface with a solution containing approximately five to ten parts water to one part muriatic acid;

brushing said surface with a stiff bristle broom to promote dispersion and interaction between said solution and said surface;

before said solution dries, pressure cleaning said surface with water at a pressure of about 3,000 psi (about 200 kg/cm$^2$) to remove said solution;

placing a template made of a flexible plastic and having a pattern formed of a plurality of openings therein onto said surface, said template having a thickness;

applying a layer of a composition to said surface, said composition including water, an acrylic latex polymer, cement, sand, and an oxide powder color additive, said composition applied to said openings of said template to a thickness of no more than said thickness of said template;

removing said template from said surface before said composition cures, said template leaving lines in said layer;

as said layer begins to cure, lightly wiping said layer with a damp sponge;

cleaning composition from said lines;

scoring said layer to simulate old brick using a textured roller;

removing accumulated dust and grit from said layer; and applying a sealer to said layer.

2. The method as recited in claim 1, wherein said acrylic latex polymer is styrene butadiene.

3. The method as recited in claim 1, wherein said composition further comprises a curing retardant.

4. The method as recited in claim 1, wherein said composition has a temperature between 45° F. and 90° F. when applied.

5. The method as recited in claim 1, wherein said step of removing dust and grit from said layer comprises blowing air onto said layer with an air blower.

* * * * *